United States Patent [19]

Teraoka

[11] Patent Number: 4,544,287

[45] Date of Patent: Oct. 1, 1985

[54] PRINTING CONTROL APPARATUS FOR A LABEL PRINTER, METHOD OF USING THE APPARATUS, AND A LABEL USED IN CONJUNCTION WITH THE APPARATUS

[75] Inventor: Kazuharu Teraoka, Tokyo, Japan

[73] Assignee: Teraoka Seikosho Co., Ltd., Tokyo, Japan

[21] Appl. No.: 521,902

[22] Filed: Aug. 10, 1983

Related U.S. Application Data

[63] Continuation of Ser. No. 230,004, Jan. 30, 1981, Pat. No. 4,422,376.

[30] Foreign Application Priority Data

| | | | |
|---|---|---|---|
| Feb. 16, 1980 | [JP] | Japan | 55-19016[U] |
| Jul. 18, 1980 | [JP] | Japan | 55-98882 |
| Jul. 22, 1980 | [JP] | Japan | 55-103394 |
| Sep. 2, 1980 | [JP] | Japan | 55-15104 |

[51] Int. Cl.[4] ..... B41J 3/20

[52] U.S. Cl. ..... 400/120; 346/76 PH; 400/356

[58] Field of Search ..... 101/27, 31, 35, 21, 101/288, 69; 400/120, 583.4, 617, 82, 95, 356; 156/DIG. 27; 346/76 PH

[56] References Cited

U.S. PATENT DOCUMENTS

| | | | |
|---|---|---|---|
| 3,563,175 | 9/1968 | Torresen et al. | 101/306 |
| 3,810,192 | 5/1974 | Okabe | 400/617 |
| 3,902,409 | 9/1975 | Filsinger et al. | 101/27 |
| 3,929,215 | 12/1975 | Hayakawa | 400/120 |
| 3,955,663 | 5/1976 | Ecker | 400/120 |
| 3,973,111 | 8/1976 | Washiznkg | 101/31 |
| 4,019,187 | 4/1977 | Omori et al. | 101/35 |
| 4,181,560 | 1/1980 | Maitland | 101/27 |
| 4,225,251 | 9/1980 | Klimek et al. | 400/120 |
| 4,240,862 | 12/1980 | Ishiyama | 101/66 |
| 4,264,396 | 4/1981 | Stewart | 101/288 |
| 4,268,179 | 5/1981 | Long et al. | 400/120 |
| 4,268,838 | 5/1981 | Nakano et al. | 400/120 |
| 4,276,112 | 6/1981 | French et al. | 101/288 |
| 4,297,039 | 10/1981 | Lees | 400/120 |
| 4,325,774 | 4/1982 | Sato | 156/DIG. 27 |
| 4,369,582 | 1/1983 | Pfeffer | 156/DIG. 27 |
| 4,384,525 | 5/1983 | Sato et al. | 101/288 |

FOREIGN PATENT DOCUMENTS

| | | | |
|---|---|---|---|
| 57-69077 | 4/1982 | Japan | 400/583.4 |
| 1473868 | 5/1977 | United Kingdom . | |

*Primary Examiner*—William Pieprz

*Attorney, Agent, or Firm*—Sandler & Greenblum

[57] ABSTRACT

Printing control apparatus includes structure for selectively preventing the operation of a thermal head comprising part of a label printer for thermosensitive labels. The thermal head can be moved away from and into contact with a label to limit its operational printing period. Alternately, thermal elements comprising a portion of the thermal head can be deactivated when a label detector fails to detect the presence of a label at a predetermined position, when the contact between the thermal head and a label is inadequate, or when the transportation or feeding of the label over a predetermined path within the printer is abnormal. A method for using the apparatus to selectively prevent the thermal head from being operational is also provided. A thermosensitive label is adapted to be used in conjunction with the apparatus and method and includes a substrate layer and a thermosensitive coloring layer comprising a color former and a transparent dye.

18 Claims, 21 Drawing Figures

PRINTING CONTROL APPARATUS FOR A LABEL PRINTER, METHOD OF USING THE APPARATUS, AND A LABEL USED IN CONJUNCTION WITH THE APPARATUS

This is a continuation of application Ser. No. 230,004 filed Jan. 30, 1981 now 4,422,376, dated Dec. 27, 1983.

BACKGROUND OF THE INVENTION

1. Technical Field of the Invention

The present invention generally relates to a label printer, method, and label, and more particularly to a printing control apparatus for a label printer used in department stores and supermarkets for automatically printing indicia, e.g., a commodity name, price, manufacturing date, store name and bar code on a label which is adapted to be adhered to a corresponding commodity. Even more particularly, the present invention relates to an improved printing control apparatus for a label printer in which a number of thermal elements are disposed in a transverse direction to form a thermal head which is adapted to be brought into contact with the printable surface of a thermosensitive coloring label, and whereby the thermal elements are energized in accordance with printing information received and wherein either the thermal head or the label is moved parallel to the printing surface and perpendicularly to the transverse alignment of the thermal elements in order to print specified or desired marks and other indicia on the label.

The present invention also relates to a method of printing using the apparatus and to a label utilized in conjunction with the above-referred to label printer.

2. Description of the Prior Art

In conventional label printers of this general type, a strip of base paper on which labels are separably adhered at predetermined intervals or spacings is fed intermittently so that each label, when positioned at the appropriate position for printing, will be brought into contact with a thermal head having a predetermined pressure applied thereto in order that marks can be printed on the printing surface of the label.

In such arrangements, the thermal head is in continuous contact either with a label or with a strip of base paper on which the labels are adhered, the latter in areas in which no labels are adhered. Consequently, the thermal head is easily worn out and contaminated, often resulting in poor print quality and printer failure.

In such label printers, the heat of the thermal head which is needed for printing is generated by current conduction and must be dissipated appropriately through a label, which is made of thermosensitive coloring paper.

However, if no labels remain at the end of a strip, if a label is for any reason missing from the strip, or if the pressing device malfunctions and thereby fails to press the thermal head to the label in an appropriate fashion, the thermal head will be spaced from the label at the time of printing. Accordingly, the heat of the thermal head will not be dissipated through a label, and damage will thereby be caused to the thermal head due to overheating. Such abnormal operation not only shortens the service life of the thermal head, but also causes poor quality printing on the labels.

Moreover, if the transportation device for moving the strip and labels does not operate normally, e.g., due to a slip or a jam of a label, or if for some other reason the label is not fed smoothly through the machine, the thermal head will continue to print at the same location of a label for a relatively long period of time, thereby causing undesireable heat accumulation at the head, which in turn can cause damage to the head through overheating.

Labels used in conjunction with the aboveidentified conventional label printers are made from paper or synthetic resin film, and fixed printed items, including frames, store name and address are often printing in advance, any and all variable print items, including the unit price, quantity, weight, price and bar code being printed at each store at a later time using a printer. The reason for separate printing is that it is not possible for prior art printers to print colorful frames, store names and addresses for attracting customers on labels which are made of paper or synthetic resin film.

Therefore, conventional labels have been required to be partially printed in advance, which is expensive, and therefore do not generally allow for the printing of colorful descriptions for specially advertised commodities.

SUMMARY OF THE INVENTION

In view of the foregoing, the present invention is intended to improve the printing operation of a label printer having a thermal print head, and it is there a primary object of the invention to provide a label printer having a printing operation which is controlled so that its thermal head will be brought into contact with the printing surface of a label only when the head is energized, thereby minimizing the wear of the thermal head, providing a longer service life for the device and preventing contamination of the head to allow for clearer printing.

According to one aspect of the present invention, a print control apparatus for label printers is provided, the apparatus having a number of thermal elements which are disposed in a transverse direction to form a thermal head, the thermal head adapted to be brought into contact with the printing surface of a thermosensitive color label, the thermal elements being energized in accordance with printing information received, either the thermal head or the label being moved parallel to the printing surface and perpendicularly to the alignment of the thermal elements so as to print specified marks and indicia on the label, the thermal head being adapted to move into contact with and away from the label, and whereby the movement of the thermal head is controlled by a print control mechanism, such that the thermal head will be brought into contact with the label when the head is energized and maintained away from the label when the head is de-energized.

The mechanism controlled by the control mechanism and adapted to move the thermal head against the label preferably employs a solenoid, the thermal head being adapted to come into contact with the label in swinging or in a reciprocating motion produced by the solenoid.

The voltage supplied to the thermal head may be either DC voltage or pulse voltage. In the case of DC voltage, the thermal head is brought into contact with a label during voltage application, and is maintained spaced away from the label when such voltage is not applied. In the case of pulse voltage application, the thermal head is brought into contact with the label momentarily and intermittently in synchronization with voltage pulses, or the thermal head is brought into contact with the label during a period of pulse voltage application and maintained spaced away from the label when the pulse voltage is not applied.

The DC voltage application is suitable primarily for printing bar codes, and the pulse application is preferable for printing numeric and symbols in addition to bar codes.

Marks and other indicia printed on the label include aliphatic, numeric and symbolic characters and bar codes for indicating the unit price, weight, price, commodity name, manufacturing date, expiration date, commodity code, etc. on any given label.

The label printer may be of the type adapted for printing labels which are adhered to a strip of base paper at predetermined intervals and in which the strip of paper, with the labels adhered thereto, is fed intermittently into the printer, so that each label will reach the printing position and will be printed when it reaches this position, or the printer may be of the type in which a label strip composed entirely of thermosensitive color paper is intermittently fed into the printer and is thereafter cut into pieces representing individual labels after each label area has been printed at the printing position.

The printing control mechanism comprises a storage unit, control unit and computational unit, and controls the movement of the thermal head by using the input signals from a input unit which receives printing data, a signal from a label position detector, and data which is stored in the storage unit for determining the top and bottom margins and the printing interval, thereby bringing the thermal head into contact with a label when the head is energized and moving the head away from the label when the head is de-energized.

A second object of the present invention is to provide a label printer which is adapted to vary the label feed rate so as to minimize printing time, whereby the control apparatus has a thermal head which is adapted to be moved into contact with and away from the label, the movement of the thermal head being controlled by the printing control mechanism such that the head will be brought into contact with the label when the head is energized and maintained away from the label when it is de-energized, and whereby the label feed rate is controlled by the printing control mechanism so that the label or strip will be transported rapidly when the thermal head is maintained away from the label and more slowly when it is in contact therewith.

A third object of the present invention is to provide a label printer which minimizes or eliminates trouble relating to the failure of the thermal head to dissipate heat during a period of printing, this being achieved by de-energizing the thermal head, thereby enhancing the durability of the thermal head and insuring clear printing for a relatively long period of time.

The control apparatus according to this aspect of the present invention comprises control means in a thermal head drive circuit for detecting abnormal contact between the thermal printer and a label and for deactivating the drive circuit when such an abnormality is detected.

The state of abnormal contact between the thermal head and a label occurs under certain circumstances, e.g., when labels have run out, when a new label roll is applied while the thermal head is spaced away from the label, or when the thermal head is entirely or partially spaced from the label strip due to a failure or deficiency of the pressing device.

The control means functions to detect abnormal contact between the thermal head and the label and also to deactivate the drive circuit upon detection of any such abnormal contact. Both operations may be carried out by two separate members or by a single member. For example, the control means can comprise a first switch with a moving part linked to the label position detector or the pressing device and a normally closed switch provided on the drive line of the drive circuit. With such structure, when the absence of a label, failure of the pressing device or retraction of the thermal head is detected by the detector, the thermal head drive circuit is deactivated so that the thermal head will be de-energized at the time of printing.

A fourth object of the present invention is to provide a label printer in which the thermal head is de-energized when an abnormality in transportation is detected, thereby preventing the thermal head from being damaged due to overheating and maintaining the quality of printing. The control apparatus according to this aspect of the present invention comprises a label position detector and a stepping motor which are provided in the print control mechanism so that a signal of abnormality derived from the control section will be supplied to a normally closed switch provided in the thermal head drive circuit, the number of rotational steps of the stepping motor being compared with the signal from the label position detector, the normally closed switch being opened if and when abnormal transportation is detected.

A fifth object of the present invention is to provide labels used in conjunction with the abovedescribed label printer. The label according to this invention is formed from a sheet or substrate having a thermosensitive coloring material applied to its surface and which can color print both fixed items, e.g., frames, store names and addresses, and variable print items, e.g., a unit price, quantity, weight, price and bar code of a commodity, and additionally, descriptions for specially advertised commodities.

According to a first aspect of the present invention, a printing control apparatus is used in conjunction with a thermal label printer. The printer comprises a thermal head which includes a plurality of transversely disposed thermal elements. The head is adapted to be placed into contact with the printable surface of a thermosensitive color label and the thermal elements are adapted to be energized in accordance with printing information received. At least one of the head and label is adapted to be moved parallel to the printing surface and perpendicularly to the transverse disposition or alignment of the thermal elements for printing predetermined indicia on the label. The printing control apparatus includes means for selectively preventing the thermal head from being placed into an operative printing condition.

According to a second aspect of the present invention, a label is adapted to be used in conjunction with a label printer of the type comprising a thermal head having a plurality of thermal elements. The label comprises a substrate having an upper and lower surface and a sheet of thermosensitive coloring material on its upper surface.

According to a third aspect of the present invention, a method of using printing control apparatus is used with a printer for printing labels as part of a process in which a thermal head comprising a plurality of thermal elements is brought into contact with a thermosensitive label in order to print said label. The method comprises selectively preventing the thermal head from being placed into an operative printing condition.

BRIEF DESCRIPTION OF THE DRAWINGS

The above and other objects, features and advantages of the present invention will become more fully apparent to those of ordinary skill in the art to which this invention pertains from the following detailed description, when considered in connection with the accompanying drawings, in which like reference characters designate like or corresponding parts throughout the several views, and wherein.

DETAILED DESCRIPTION OF THE DRAWINGS

Figure 1:
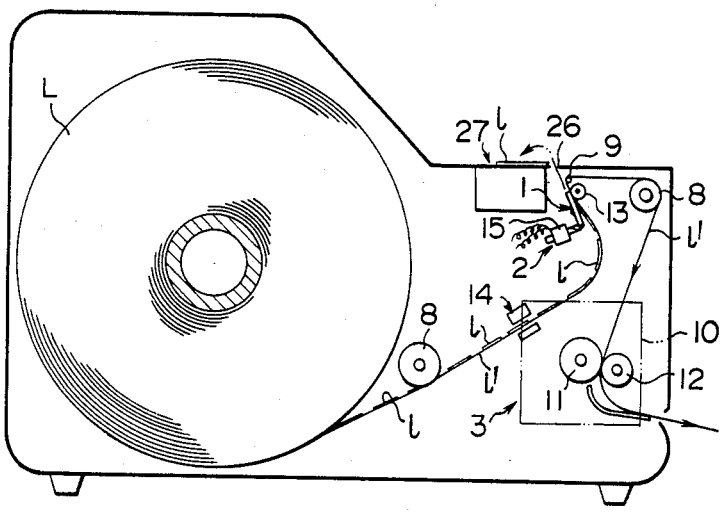
FIG. 1 is a sectional side view of a label printer formed in accordance with the present invention.

With more specific reference to the drawings, reference 1 is a sectional side view of a label printer A formed in accordance with the present invention and shows a web, roll, or sheet R of labels L, a thermal head 1 mounted on thermal head moving mechanism 2, the thermal head being adapted to be brought into contact with and moved away from a label, label transportation mechanism 3, and print control mechanism 4.

Figure 9:
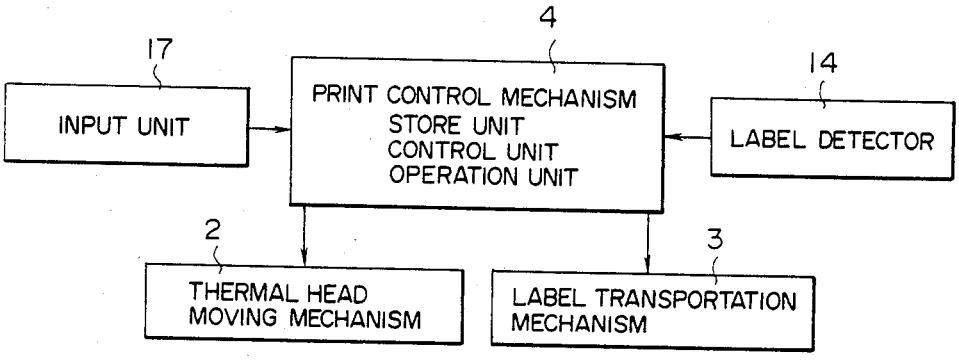
FIG. 9 is a block diagram illustrating the input/output relationship of the label printer.

The print control mechanism is best illustrated in schematic form in FIG. 9.

Figure 3:
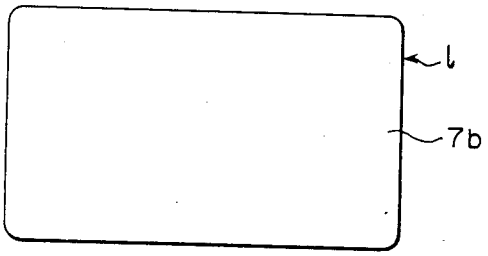
FIG. 3 is a plan view of a label used in conjunction with the label printer of FIG. 1.
Figure 4:
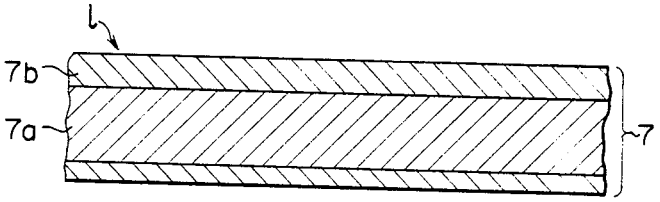
FIG. 4 is an enlarged side view of the label of FIG. 3.
Figure 6:
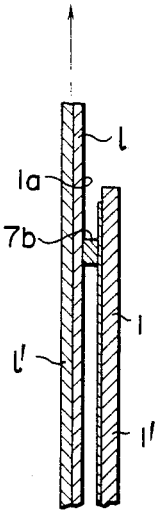
FIG. 6 is a sectional side view illustrating the left-hand portion of the label printer illustrated in FIG. 5.
Figure 5:
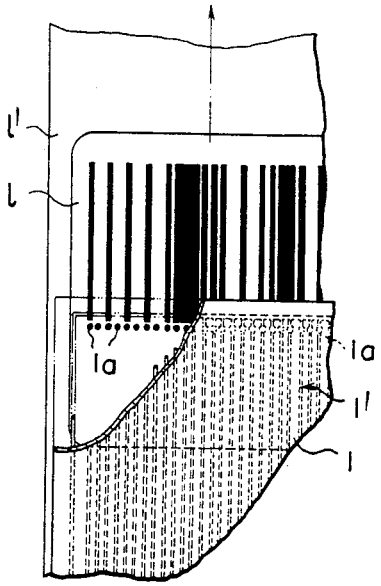
FIG. 5 is a partially cut-away front view of the label printer which shows the printing operation of the thermal head.

Labels L can be cut out from a sheet of thermosensitive paper 7 having adhesive 6 applied to its back surface. Each label is cut into a generally rectangular configuration having rounded corners, as best illustrated in FIGS. 3 and 4. The thermosensitive paper includes a thermosensitive color layer **7*b* which is formed by the application of a thermosensitive coloring material consisting of a color former and a transparent dye to the surface of base paper sheet 7*a***. The thermosensitive material is originally seen as white, but once heated to a predetermined temperature, changes instantaneously to display a predetermined color. More particularly, the color former is melted instantaneously by the thermal head, which absorbs the transparent dye to cause a chemical reaction and thereby a color to be produced as a result.

Each label L can be separably adhered by means of adhesive at a predetermined spacing or interval along base paper sheet L', which is fed from label roll R. Base paper L' is placed on guide rollers 8, dispenser 9, feed roller 11, which is positioned on the drive shaft of stepping motor 10, and pinch roller 12, and is adapted to be fed through the space located between thermal head 1 and platen roller 13, which space is provided upstream of dispenser 9, and is further adapted to be fed through label detector 14, which is located upstream of the thermal head and platen roller and adapted to detect the position of each label. The labels could alternately comprise a web of material which could be cut into individual labels after printing.

Figure 7:
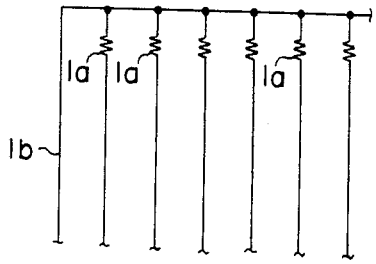
FIG. 7 is a wiring diagram illustrating the interconnection of the thermal elements comprising the thermal head.

On one side of main assembly 1' of thermal head 1, a plurality of small thermal elements **1*a* are aligned transversely at a predetermined spacing or interval. One end of each thermal element 1*a* is connected to a common line 1*b* (see FIG. 7) by printed wiring, and another end is connected to a drive circuit through which a pulse is applied to the thermal elements. The pulse voltage is applied from the control unit in control mechanism 4 when thermal head 1** is in contact with a label L.

Figure 8:
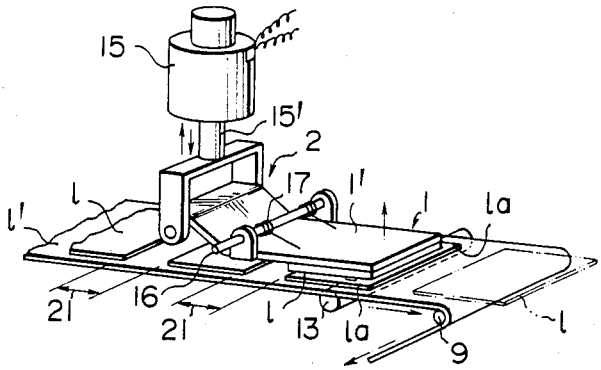
FIG. 8 is an enlarged perspective view of the moveable mechanism comprising the thermal head.

Platen roller 13 is provided in opposed relation to thermal head 1, as seen in FIG. 8. The roller has an appropriate pressure applied thereto so that each label L on base paper sheet L' is brought into pressure contact with thermal elements **1*a* of thermal head 1. Dispenser 9 is provided downstream of thermal head 1 and platen roller 13** for separating each printed label L from base paper sheet L' and also for guiding the base paper layer L' therefrom.

Thermal head moving mechanism 2 is provided for moving thermal head 1 into contact with print surface **7*b* of each label L which has been fed in the forward direction, and also for then retracting the head from the label. This mechanism pivotably or swingably supports thermal head 1 and includes solenoid 15 mounted on the back of main assembly 1'. The operation of solenoid 15 is controlled by print control mechanism 4, as detailed hereinafter. When a pulse voltage is supplied from print control mechanism 4 to thermal head 1, the solenoid is energized to pull in its armature 15' while the pulse voltage is being applied to the thermal head, so as to bring it into contact with print surface 7*b* of each label L. When voltage applcation is halted, armature 15' is released and thermal head 1 swings off printing surface 7*b* of each label L, due to the action of coiled spring 17 which is provided on pin 16, which in turn pivotably supports thermal head 1, as best illustrated in FIG. 8**.

The thermal head moving mechanism 2 may be arranged in another fashion, so that thermal head 1 will be retracted from the printing surface of label L when solenoid 15 is energized to pull-in its armature 15' and the thermal head then brought into contact with the label with the solenoid is de-energized.

The label transportation mechanism 3 comprises stepping motor 10, feed roller 11 secured on the drive shaft of the stepping motor, pinch roller 12, and label detector 14. The rotation of stepping motor 10 is controlled by print control mechanism 4. When thermal head 1 is in contact with the label L in condition for printing indicia, the stepping motor steps over a predetermined rotational angle in synchronization with voltage pulses applied to the thermal head, so that images on the printing surface of each label L which is printed by thermal elements 1*a* of thermal head 1 will overlap. When each space 21 between contiguous or adjacent labels passes the thermal head, the stepping motor is controlled to rotate at a rapid feed rate. The label transportation mechanism is halted when label detector 14 either detects a label next to a printed label or a label next to a label which is detected at the time of label printing. This halted state lasts until a subsequent printing command is issued.

Print control mechanism 4 operates in synchronized fashion, thermal head moving mechanism 2 and label transportation mechanism 3 in accordance with the input signal from input unit 5, the detected signal from label detector 14 and the data stored in the storage unit, which indicates the top and bottom margins 18 and 19 for each label L and the blank space 20 between printed marks. The mechanism halts transportation of the labels when label detector 14 senses the leading edge La (see FIG. 8) of each label L and keeps each label at a predetermined position until a subsequent printing command is issued. Upon reception of a printing command, the label roll R is fed over a length corresponding to that stored in the storage unit and equivalent to top margin 18. Following this feeding operation at a predetermined feed rate, solenoid 15 is energized to bring thermal head 1 into contact with a label L. Thereafter, voltage pulses are supplied to thermal head 1 with label L transported at a jog, or relatively slow, feed rate in synchronization with the voltage pulses.

When printing a single mark, solenoid 15 is de-energized upon completion of printing, and thermal head 1 is retracted from label L. Thereafter, the label sheet or web R is transported or moved across the bottom margin 19 in space 21 between labels, until the leading edge La of the next label is detected by label detector 14.

When printing two or more spaced apart marks, the control sequence is established such that label L is transported across blanks 20 between printed marks, solenoid 15 being de-energized and thermal head 1 being kept off the label.

Figure 2:
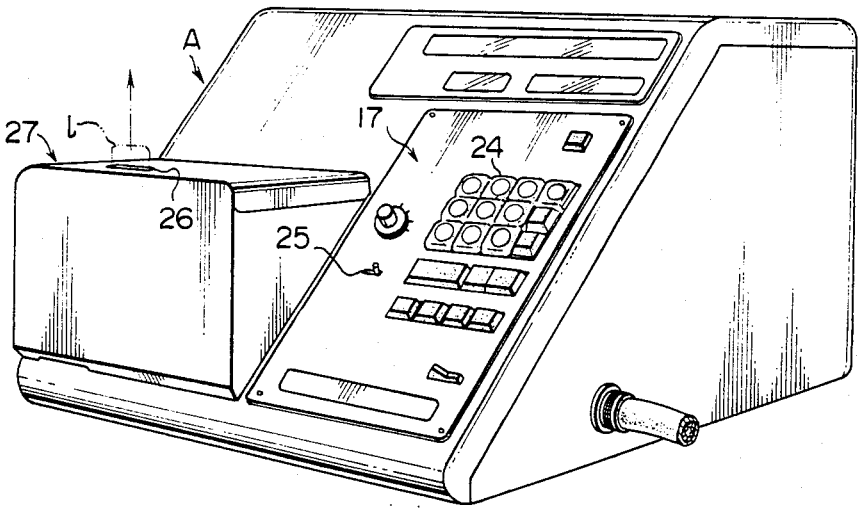
FIG. 2 is a perspective view of the label printer of FIG. 1.
Figure 10:
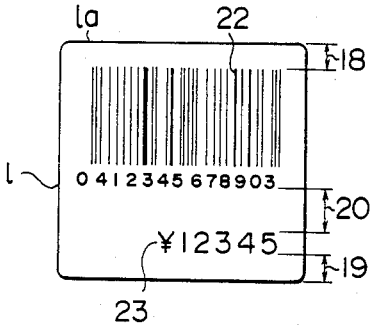
FIG. 10 is a plan view illustrating an example of a label having a bar code printed thereon.

For printing a bar code label L as shown in FIG. 10, in which bar code 22 and characters 23 representing the price are printed, lengths of the top margin 18, bar code 22, and the blank space 20 between the bar code 22 and price 23 are stored in advance in the storage unit of print control mechanism 4 and only bar code data is entered through entry key 24 on the input unit 17. In this case, PROGRAM/LABEL issue switch 25 is set to PROGRAM, as illustrated in FIG. 2.

After switch 25 is changed over to LABEL ISSUE following the entry of bar code data, a print command is issued and print control mechanism 4 operates the label transportation mechanism to feed label L over a length equal to top margin 18. After top margin 18 of label L has been transported, print control mechanism 4 activates thermal head moving mechanism 2, and thermal head 1 is brought into contact with the printable surface of a label L at a predetermined pressure applied thereto by the action of solenoid 15. More particularly, thermal elements 1*a* of thermal head 1 come into contact with the printable surface of each label L, with a space being left after the leading edge La of label L for a length equal to top margin 18.

As soon as thermal head 1 comes into contact with a label L, voltage pulses processed according to the input signal are applied to thermal head 1 and, at the same time, label L is transported at the jog feed rate in synchronization with voltage pulses, thereby printing a bar code 22 on the upper printing area of the label L.

On the completion of printing a bar code, application of voltage pulses to thermal head 1 is halted and solenoid 15 is de-energized. Thereafter, the thermal head moves away from label L so that each label L is fed or moved over a predetermined distance which corresponds to the length of blank space 20 between the marks.

After label L has been transported over a distance equal to the length of blank space 20, solenoid 15 is energized again to bring thermal head 1 into contact with the printable (upper) surface of lable L. At the same time, voltage pulses representing information about the price are applied to thermal head 1 and label L is transported at the jog feed rate so that the price 23 (shown as " 12345" in FIG. 10) is printed so that a predetermined space will be left after bar code 22.

After price 23 has been printed, solenoid 15 is de-energized and thermal head 1 moved away from label L. Simultaneously, label L is transported and a bar code label L, on which bar code 22 and price 23 are printed, is then separated from base paper sheet L' by dispenser 9. The printed label is then ejected from label delivery port 26 and placed on label suction unit 27. Label transportation is halted when label detector 14 senses the leading edge La of the next label, i.e., when leading La of the next label L is positioned at a specified position upstream of thermal elements 1*a*.

Accordingly, wear of the thermal head can be reduced and contamination of the head, which is caused by dust on the base paper and on the labels, can be prevented, thereby providing precise and clear printing for a long period of time.

A second control means formed in accordance with the present invention, by which the label feed rate can be varied, will now be described in detail.

Transporation of label L is controlled by print control mechanism 4. Label transportation is placed into the jog feed rate, which takes place during printing, and a rapid feed rate, which occurs during periods of non-printing, the length of the top and bottom margins 18 and 19, respectively, of the label L, and the length of blank space 20 between markings or indicia, being stored in advance within the storage unit of print control mechanism 4, thermal head moving mechanism 2 and label transportation mechanism 3 being operated in synchronized fashion to feed each label L along a predetermined path. More particularly, transportation of labels L is halted when label detector 14 senses the leading edge 1*a* of label L, and when a print command is subsequently given, each label L is transported at the rapid feed rate over a length equal to top margin 18, which length information is stored within the storage unit. Upon completion of this feed operation, solenoid 15 is energized to bring thermal head 1 into contact with label L and voltage pulses are applied to thermal head 1, with label L being transported at the jog feed rate in synchronization with the voltage pulses.

When printing a single mark, solenoid 15 is de-energized upon the completion of printing and the thermal head then retracted from a label L. Thereafter the label sheet is transported at the rapid feed rate across the bottom margin 19 and space 21 between labels until the leading edge La of the next label is detected by label detector 14.

When printing two or more marks which are spaced apart, label L is transported over a length equal to the blank space 20 between marks at the rapid feed rate, with solenoid 15 being de-energized and thermal head 1 being maintained away from a label.

Accordingly, when printing a bar code label L, as shown in FIG. 10, on which bar code 22 and characters 23 representing the price are printed, the label L is transported across top and bottom margins 18 and 19, blank space 20 between bar code 22 and price 23, and space 21 between contiguous labels, at a higher feed rate then the job feed rate which occurs while printing bar code 22 and price 23.

Accordingly, the printing time can be reduced in comparison with the situation in which a label is transported from its leading edge to its trailing edge at the printing feed rate, or the case in which a label is transported from the first mark to the last mark at the constant printing feed rate.

Figure 11:
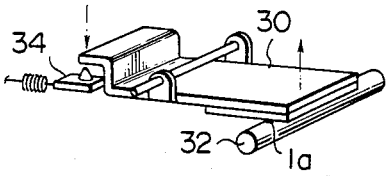
FIG. 11 is an enlarged perspective view illustrating a portion of a thermal head in accordance with a second embodiment of the present device.

A third print control means formed in accordance with the present invention is hereinafter described with specific reference to FIGS. 11 through 13.

Thermal head 30 has thermal elements 1*a* disposed therein and is pivotably supported so that one end of thermal elements 1*a* are brought into pressure contact with platen roller 32, in the same fashion as is described with respect to the intial embodiment. At another end of thermal elements 1*a*, switch 34 is provided for detecting the opening of thermal head 30; the switch closes its contacts when the distance between thermal elements 1*a* and platen roller 32 exceeds a predetermined value.

The thermal head 30 and platen roller 32 constitute a label pressing device.

The aforementioned label detector 14 is provided to detect label L when it reaches the detector so as to stop label L at a specified position of thermal head 1. Detector 14 also functions to detect the presence of labels L on base paper sheet L'.

Figure 13:
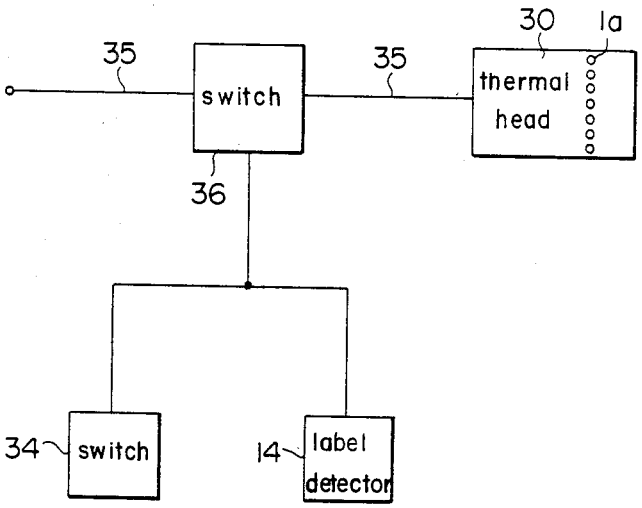
FIG. 13 is a block diagram of one control means of the present invention.

The thermal head drive circuit 35 of label printer A includes a normally closed switch 36, which is connected with label position detector 14 and switch 34, as illustrated in FIG. 13. The normally closed switch 36 is arranged so that it opens its contacts when detector 14 does not detect a label L, e.g., when a web of labels has run out and no label is left on base paper sheet L', and it also opens its contacts when switch 34 is closed.

With such an arrangement, if labels run out during the operation of label printer A, detector 14 causes switch 36 to open and deactivate drive circuit 35, thereby de-energizing thermal head 30. Accordingly, even if thermal head 30 enters the printing phase (which is defined as the period of time during which thermal head 30 receives current sufficient to print on label L) in the absence of any labels, conduction of current to thermal elements 1*a* will be suspended, thereby preventing thermal head 30 from heating when the thermal head and a label L are not in contact with one another.

Figure 12:
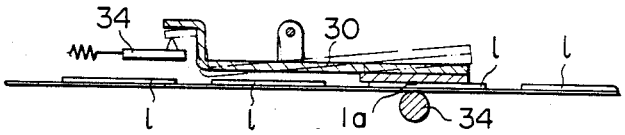
FIG. 12 is a sectional side view of the thermal head of FIG. 11.

Furthermore, when one end of thermal head 30 is depressed to lift the head, as illustrated by the dotted lines in FIG. 12, in order to supply a new label roll R, switch 34 is closed and switch 36 thereby opens to deactivate drive circuit 35. Accordingly, when a new supplied label L is fed, while thermal head 30 is maintained in a raised or lifted position, thermal head 30, which is maintained away from labels L, is not activated, even if a print command is issued, and thermal head is thereby prevented from heating.

Furthermore, if a label jams between thermal head 30 and platen roller 32, forcing thermal head 30 to lift against the pressure, a space is created between thermal elements 1*a* and the label L. In such circumstances, if all or any of thermal elements 1*a* are not in contact with label L, switch 34 opens to deactivate drive circuit 35 and thermal head 30 is de-energized.

The combination of detector 14, switch 34 and switch 36 comprise control means for this embodiment of the present device.

This embodiment has been described for the situation in which both detector 14 and switch 34 are connected with switch 36; however, either detector 14 or switch 34 alone may be connected with switch 36 and still constitute control means as referred to herein.

As described above, the thermal head drive circuit is provided with control means, which deactivate the circuit when it detects an abnormal contact between the thermal head and the label. Thus, if the thermal head is kept apart from the label due to the presence of the end of a label roll, setting of a new label roll or failure of the pressing device, the thermal head will be de-energized.

Accordingly, the disadvantages of known thermal heads relating to heat dissipation during the printing period can be eliminated. The thermal head can be prevented from damage caused by overheating, thereby enhancing the durability and precision of the thermal head and achieving precise and smooth printing operation.

Figure 14:
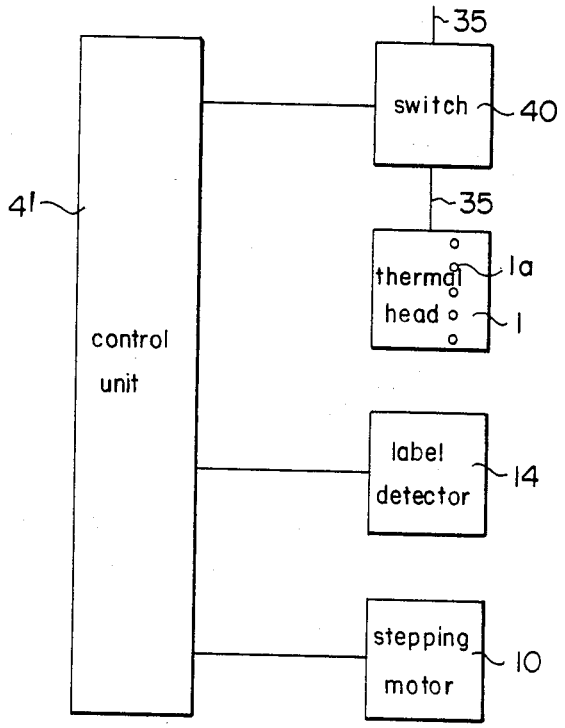
FIG. 14 is a block diagram of another control means of the present invention.

A fourth embodiment of a control means of the present device will now be more specifically explained with respect to FIG. 14, which includes control unit 4' provided within print control mechanism 4, stepping motor 10 in label transportation mechanism 3, label detector 14, thermal head 1 comprising thermal elements 1*a*, and thermal head drive circuit 35. Control unit 4' connects label detector 14, stepping motor 10 and normally closed switch 40, which is provided in thermal head drive circuit 35, and unit 4' compares the number of operational steps of stepping motor 10, which are stored in the unit and which represent the interval between labels L adhered to base paper sheet L', and with a signal indicating the presence or absence of a label at a predetermined position as detected by position detector 14. The normally closed switch 40 is operated by the control unit in the following three control modes:

(1) Label detector 14 initially detects a "no-label" state at a position between a label L and a succeeding label L. After a "presence of label" state is thereafter detected, when "no-label"0 is detected at a time after which stepping motor 10 has rotated over a predetermined number of steps, label transportation will be determined as being normal;

(2) Label detector 14 initially detects the "no-label" state. Subsequently, after it has detected the "presence of label" state, and stepping motor 10 rotates over a preset number of steps, with "presence of label" still being detected, both signals do not coincide with a preset condition and label transportation is determined to be abnormal. Such malfunction is caused by slippage of the label transportation mechanism; and (3) Label detector 14 initially detects the "no-label" state and does not detect a "presence of label" state until after the stepping motor has rotated over a predetermined number of steps. Both signals do not coincide with the preset condition, and label transportation is therefore determined to be abnormal. Such malfunctioning is caused by a jamming of the label roll, which disables the label transportation mechanism.

Control unit 4' opens normally closed switch 40 when the label transportation mechanism makes a slip in feeding a label or when a label jam occurs and disables the mechanism. The control unit keeps normally closed switch 40 closed when label transportation is normal.

As described above, the thermal head drive circuit is deactivated when a label transportation abnormality, e.g., a slip of the label transportation mechanism or a label jam has occured.

According, disadvantages of the thermal head relating to heat dissipation during the printing period can be eliminated. The thermal head can be prevented from damaged caused by overheating, thereby enhancing the durability and precision of the thermal head and achieving precise and smooth printing operation.

Figure 15:
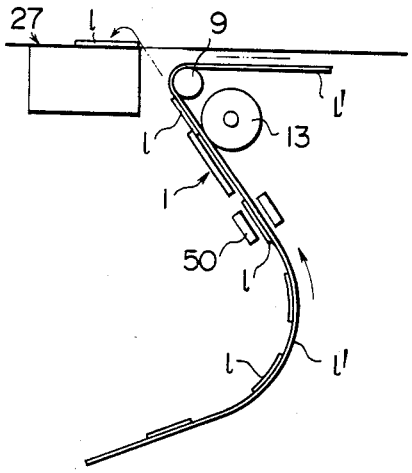
FIG. 15 is an enlarged side schematic view illustrating a portion of another embodiment of a label printer formed in accordance with the present invention.
Figure 16:
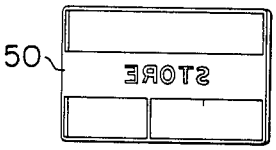
FIG. 16 is a perspective view of a thermal plate for printing fixed print items on a label.

Another method of printing a label L will now be described with specific reference to FIGS. 15 through 19. In FIG. 15, a thermal plate 50 is provided upstream of thermal head 1 of a label printer. The remaining portions of the printer are the same as those in label printer A of FIG. 1. Thermal plate 50 is formed of convex configuration, such that its printing face is shaped into a predetermined print form and so that fixed print items 52 are printed on label L by thermal plate 50 prior to reaching thermal head 1. The fixed print items 52 include frames, the store name and address. Accordingly, when label L reaches thermal head 1, only variable print items 54, which vary depending upon the commodity, are printed on it. The variable print items 24 include the unit price, quantity, weight, price, commodity name, manufacturing date, expiration date, commodity code and bar code.

Figure 17:
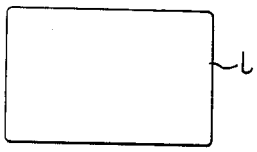
FIG. 17 is a plan view of a label prior to printing.
Figure 18:
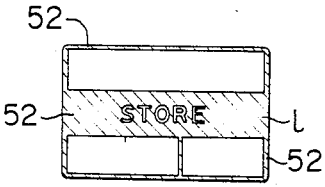
FIG. 18 is plan view of the label of FIG. 17 having fixed print items printed thereon.

A blank label, as shown in FIG. 17, is fed at the jog feed rate by the label transportation mechanism 3 and is stopped in front of thermal plate 50. Upon proper positioning of label L, thermal plate 50 moves into contact with label L and prints item 2. After printing, the thermal plate returns to its original position. FIG. 18 illustrates a label on which fixed print items 52 have been printed.

Figure 19:
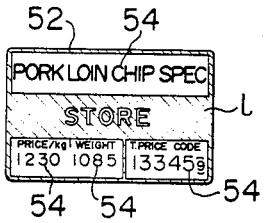
FIG. 19 is a plan view of the label of FIG. 18 after having variable print items printed thereon by the thermal head.

After thermal plate 50 is retracted, label L is transported through the space between thermal head 1 and platen roller 13 at a predetermined feed rate, and during this passage, the variable print items 54 are printed by thermal head 51, as shown in FIG. 19. For printing the fixed items 52 in multiple colors, labels made of multi-coloring paper are used and thermal plates providing different coloring temperatures are employed. For printing variable items 54 in multiple colors, labels made of multi-coloring paper are used and a plurality of thermal heads providing different coloring temperatures are employed.

Figure 20:
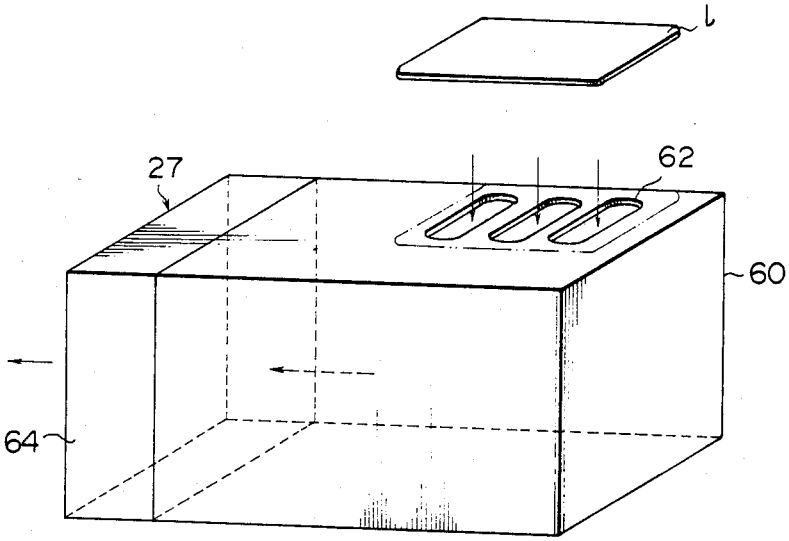
FIG. 20 is a perspective view illustrating a label illustrating a label suction unit in accordance with the present invention.

FIG. 20 is an illustration showing in detail a label suction unit 27 of label printer A. The label suction unit 27 is located near label delivery port 26 and sucks the label by air pressure so that each label L delivered from the label delivery port 26 will be maintained so that adhesive surface 6 faces upwardly.

The label suction unit 27 is formed from box 60, which has one or more air suction ports 62 on its upper surface and an air exhausting port 64 having a fan or similar device. The air suction ports 62 are located near label delivery port 26, and hold a label L which has been separated from base paper sheet or strip L' and injected out of delivery port 26 by air pressure so that adhesive surface 6 faces upwardly.

Figure 21:
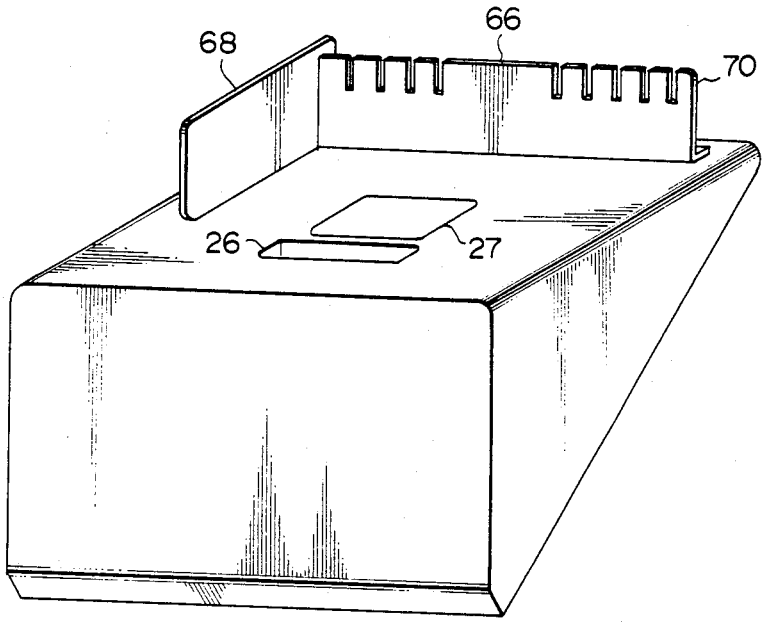
FIG. 21 is a perspective view illustrating another embodiment of a label suction unit.

Label suction unit 27 is located substantially parallel to the top of the table of label printer A so that a label can be adhered to a commodity by using either hand while handling the commodity with the remaining hand. However, it is also possible to arrange the apparatus so that commodity guide 70, which comprises a backboard 66 and a sideboard 68, will be positioned on the periphery of label suction unit 27 and label delivery unit 26 as shown in FIG. 21, and a label L held on the top of label suction unit 27 will correctly register with the specified position of a commodity. It is also possible to arrange guide 70 so that it can be moved in any direction on the table of the label printer. In the above embodiment, guide 70 comprises two boards; alternately, it may comprise three boards.

As described above, label suction unit 27 is provided adjacent label delivery port 26 so that a label will be held with its adhesive surface facing upwardly atop the label suction unit. Thus, a label can be adhered to a commodity only by pressing it with one hand onto the label suction unit, thereby freeing the operator to pick up a delivered label and permit single hand operation. Furthermore, since the label is held firmly on the label suction unit, it can be adhered to a commodity only by placing the commodity on the label during normal operation.

In the arrangement shown in the drawings, a label is held with its adhesive surface facing upwardly on the label suction unit so that the operator can hold the commodity with one hand so that it can be pressed onto the label suction unit for adhering the label. However, the label suction plane, i.e., the label adhesive plane, may be arranged in any horizontal or vertical direction so that a label will be held onto the label suction unit with its adhesive surface facing outwardly from the unit and, accordingly, the label can be adhered to any face of a commodity in prompt and sure fashion.

From the foregoing description, one skilled in the art can easily ascertain the essential characteristics of this invention, and, without departing from the spirit and scope thereof, can make various changes and modifications of the invention to adapt it to various usages and conditions.

What is claimed is:

1. A printing assembly for printing labels using a printer controlled by a printing control apparatus, said assembly comprising:

(a) a printer comprising:

(i) a thermal head having a plurality of thermal elements which are disposed transversely to the direction of travel of said labels;

(ii) means for placing said head into contact with a printable surface of a thermosensitive color label;

(iii) means for energizing said thermal elements in accordance with printing information received from said printing control apparatus;

(iv) means for transporting said label parallel to said printable surface and perpendicularly to said transversely disposed thermal elements for printing predetermined indicia on said label; and (b) a printing control apparatus including:

(i) means for selectively preventing said thermal head from being placed into an operative printing condition, wherein said means for selectively preventing said thermal head from being placed into an operative printing condition comprises means for moving said thermal head into contact with and away from a label at any point along said label, wherein said moving means comprises means for bringing said thermal head into contact with said label at any point therealong when said thermal elements are energized and maintaining said head away from said label at any point therealong when said thermal elements are de-energized; and (ii) means for controlling the feed rate of transport of said label by transporting said label at a first rate when said thermal head is maintained away from said label and at a second rate when said thermal head is in contact with said label, wherein said first rate is substantially greater than said second rate.

2. A printing assembly in accordance with claim 1 wherein said labels travel through said printer at a feed rate, and further including means for controlling the feed rate when said thermal head is in contact with said label in order to minimize the time required for printing.

3. A printing assembly in accordance with claim 2 further comprising a label pressing device comprising said thermal head and a platen roller oppositely disposed to the thermal head, said platen roller adapted to be placed under pressure and said thermal head adapted to print predetermined indicia on a label.

4. A printing assembly in accordance with claim 3 wherein said print control apparatus comprises means for receiving information regarding the indicia to be printed on said label and the spacing to be included on said label and further comprises means for supplying current to said head at predetermined intervals.

5. A printing assembly in accordance with claim 4 wherein said current is direct current.

6. A printing assembly apparatus in accordance with claim 1 further comprising a thermal head moving means for moving said thermal head into contact with and away from said label, said thermal head moving mechanism comprising a main assembly with a solenoid controlled by and energized by voltage from a print control mechanism, wherein said assembly is adapted to pivotably or swingably move said thermal head in response to energization of said solenoid.

7. A printing assembly in accordance with claim 6 wherein said thermal head moving mechanism further comprises an armature and a pin attached to said armature and adapted to pivotably support said thermal head on said main assembly.

8. A printing assembly in accordance with claim 7 comprising means for pulling said armature in when voltage is supplied to said solenoid and said solenoid is energized, and means for releasing said armature when voltage is cut off from said solenoid and said solenoid is de-energized, respectively placing said head into contact with and moving it away from said label.

9. A printing assembly in accordance with claim 7 further comprising means for releasing said armature when voltage is supplied to said solenoid and said solenoid is energized, and means for pulling in said armature when voltage is cut off from said solenoid and said solenoid is thereby de-energized, respectively placing said head into contact with and moving it away from said label.

10. A printing assembly in accordance with claim 1 wherein a plurality of labels are fed through the label printer along a predetermined path, said thermal head being adapted to print variable indicia on said labels, said apparatus further comprising a thermal plate positioned upstream of said thermal head, said thermal plate having a predetermined form and being adapted to print fixed indicia on each of said labels prior to the printing of variable indicia on each of said labels.

11. A printing assembly in accordance with claim 10 wherein said labels are adhered to a carrier web or sheet and further comprising a dispenser located downstream of said thermal head for separating said labels from said carrier sheet or web, and a label delivery port for dispensing said labels outwardly from said apparatus.

12. A printing assembly in accordance with claim 11 further comprising a label suction unit positioned adjacent to said label delivery port and adapted to maintain each label dispensing through said label delivery port on said unit, said label suction unit comprising a box having a plurality of suction ports and an air exhaust port with a fan.

13. A printing assembly in accordance with claim 12 further comprising a commodity guide including a back board and a side board adapted to properly position a label with respect to a commodity desired to be labeled.

14. A printing assembly of claim 4, wherein said voltage is a pulse voltage.

15. A printing assembly of claim 1 further including a means to move said label parallel to said transversely disposed thermal elements.

16. A printing assembly in accordance with claim 1 wherein said transporting means is separate from and operates independently of said means for moving said thermal head.

17. A printing assembly in accordance with claim 4 wherein said printer comprises means to print a plurality of labels disposed serially, wherein said printing control apparatus further comprises means for transmitting signals to said moving means for moving said thermal head in accordance with information received regarding the spacing to be included on said labels, wherein said transmitting means comprises means for transmitting signals to said moving means for: moving said thermal head out of contact with a first label when printing is completed on said first label at any point therealong, maintaining said thermal head out of contact with said labels until said thermal head reaches a portion of a second label that is to be printed upon, said portion being any point along said second label, and moving said thermal head into contact with said portion of said second label.

18. A printing assembly comprising a printing control apparatus and a thermal label printer for printing on a printable surface of thermosensitive color labels, said printer comprising:

(a) a thermal head having a plurality of thermal elements disposed transversely to the direction of travel of said labels;

(b) means for energizing said thermal elements in accordance with printing information received from said printing control apparatus;

(c) means for transporting said labels parallel to said printing surface of said labels and perpendicularly to said transversely disposed thermal elements for printing predetermined indicia on said labels in response to signals from said printing control apparatus; and (d) means for moving said thermal head into contact with said printable surface of said labels when said thermal elements are energized at any point along said labels and for moving said thermal head away from a printable surface of said labels when said thermal elements are de-energized at any point along said labels, in response to signals from said printing control apparatus, wherein said transporting means for transporting said labels and said moving means for moving said thermal head are separate from and operate independently of each other, and wherein said printing control apparatus comprises means for producing signals transmitted to said printer for controlling said energizing means, said transporting means and said moving means.

* * * * *